United States Patent [19]

Solberg et al.

[11] 3,946,540

[45] Mar. 30, 1976

[54] HEAT SEAL CAPPER HEAD ASSEMBLY

[75] Inventors: Thomas M. Solberg, Belvidere, Ill.; Donald W. Hamil, Beloit, Wis.

[73] Assignee: Champion International Corporation, Stamford, Conn.

[22] Filed: May 13, 1974

[21] Appl. No.: 469,380

[52] U.S. Cl. ..... 53/341; 53/329; 53/367; 53/369

[51] Int. Cl.[2] ... B67B 3/12; B65B 7/28; B65B 51/10

[58] Field of Search ..... 53/329, 341, 367, 359, 53/369, 373, 201, 342, 368, 306, 379

[56] References Cited

UNITED STATES PATENTS

| | | | |
|---|---|---|---|
| 2,101,977 | 12/1937 | Bond | 53/368 X |
| 2,153,039 | 4/1939 | Darling | 53/329 |
| 3,248,851 | 5/1966 | Ford | 53/373 |
| 3,290,863 | 12/1966 | Geber | 53/373 X |
| 3,338,027 | 8/1967 | Amberg et al. | 53/341 |
| 3,418,193 | 12/1968 | Hallowell, Jr. | 53/329 UX |
| 3,425,887 | 2/1969 | Bowen | 53/329 UX |
| 3,461,649 | 8/1969 | Ermer, Jr., et al. | 53/201 |
| 3,786,616 | 1/1974 | Nalbach et al. | 53/88 |

*Primary Examiner*—Travis S. McGehee
*Assistant Examiner*—Horace M. Culver
*Attorney, Agent, or Firm*—Evelyn M. Sommer

[57] ABSTRACT

A heat seal capper head assembly for forming a closure and sealing a container with a heat seal cap having a heat shrinkable film includes an elongated housing having at one end adaptor means for releasably securing the assembly to the conventional filling apparatus for the container, while at the opposite end of the housing there is provided means for folding and heat sealing the heat seal cap to form a heat sealed closure having a central portion and a skirt portion. The folding means includes an annular folder ring secured to the housing, and an annular center collar concentric with and slidably mounted on the folder ring, with spring means disposed between the folder ring and the center collar for biasing the collar toward its extended position. The heating means is disposed internally of the annular collar and includes a disc-shaped portion for uniformly distributing heat across the central portion of the heat seal cap.

6 Claims, 4 Drawing Figures

HEAT SEAL CAPPER HEAD ASSEMBLY

BACKGROUND OF THE INVENTION

The present invention relates to a heat seal capping head assembly for use in forming a heat sealed closure having a central portion and a skirt for bottles, jars, cans and similar containers.

In one aspect of the invention, there is provided an apparatus for heat sealing supported plastic films such as polyethelene-lined aluminum foil bottle caps to the neck or pouring lip of a bottle made of polyethelene, and containing liquids such as milk, carbonated beverage, or the like, in connection with which the invention will be described.

The use of all-plastic bottles as fluid containers has been widely accepted, and has brought with it service conditions which require an extremely tight seal or closure at the lip or pouring edge of the bottle. The testing and service features associated with all-plastic containers are rigorous, and involve taking an all-plastic bottle and squeezing it as hard as possible to see if the closure or cap can be made to leak. It has been suggested to seal the cap to the bottle itself in order to meet the stringent fluid-tight requirements of the industry. The use of a heat sealing film means, of course, that the bottle has to be compatible with the heat seal cap so that sealing may be effected. Thus, for example, a polyethelene film inside an aluminum bottle cap will heat seal effectively to the polyethelene bottle, thereby meeting the requirements for the service use of the all-plastic container.

In order to obtain maximum use of equipment presently available to bottlers, it is particularly desirable that the heat sealing means be incorporated into a device similar to a conventional filling machine wherein bottles are moved by an indexing device through a series of stations. Utilizing the subject invention, as each bottle progresses through each station, one phase of the heat sealing procedure takes place, and at the end of the heat sealing operation the all-plastic bottle is returned to a conveyor means and carried away to a point where it may be readily packaged and loaded for transport to the consumer outlet.

SUMMARY OF THE INVENTION

The heat seal capper head apparatus of the subject invention is constructed so as to be capable of being releasably connected to a conventional filling apparatus for containers whereby the subject assembly may become an integral part of the filling apparatus and function at the same speed as the filler itself. In most conventional systems, the heat seal system is separate and apart from the filling apparatus, and usually operates at a slower rate of speed whereby the filling apparatus cannot be operated at its maximum speed. In addition, the provision of separate conveying systems for the filling operation and the heat sealing operation increases the capital expenditure required for the bottling plant.

The heat seal cap employed in the present invention is preferably of two piece construction consisting of a lamination of metal foil, such as 0.003 aluminum foil, and a thin layer of heat seal material on the order of 1 mm. As an alternative to laminating the heat seal material to the aluminum foil, the heat seal material may be extruded onto the aluminum foil to become a part of the foil material. The heat seal cap is applied to a container such as a bottle, jar, or can having an extended neck portion or pouring lip, with the resulting closure including a skirt portion extending over the neck portion of the container. The container which may be heat sealed by the subject invention may be made of plastic material such as polyethelene, polystyrene, polypropalene, or any other material compatible with the heat seal cap.

As embodied in conventional filling apparatus, it is desirable that the heat seal capper assembly of the subject invention include means for mechanically folding or bending the skirt portion of the heat seal cap about the neck of the bottle prior to the application of heat to the heat seal cap. In addition, it is desirable during the capping operation, that a biasing force be applied directly to the container to insure that, as the cam operated pedestal on which the bottle is positioned is moved downwardly, that the bottle is prevented from temporarily being retained within the heat seal capper head assembly which, of course, would subsequently cause the bottle to drop onto the pedestal and fall off, thereby disrupting the operation of the conveying apparatus. To this end, the subject heat seal capper head assembly includes means for constantly applying a downward force on the container against its supporting stool of the conveying apparatus. In addition, the subject invention provides a central heating means for uniformly distributing heat across the surface of the heat sealed cap in order to effect a uniform heat sealed closure for the container.

With the foregoing and other objects in view as will appear from a reading of the following specification and claims, the invention resides in the novelty and combination of parts and in the detailed construction herein described in the claims, it being understood that changes in the precise embodiment of the invention may be made within the scope of what is claimed without departing from the spirit of the invention. It will be further understood that the heat seal capper head assembly of the subject invention may be employed for effecting a closure for a single container, but preferably a plurality of such assemblies are mounted on a conventional filling apparatus for effecting a series of closures.

DESCRIPTION OF THE PREFERRED EMBODIMENT

Figures 1, 1A:
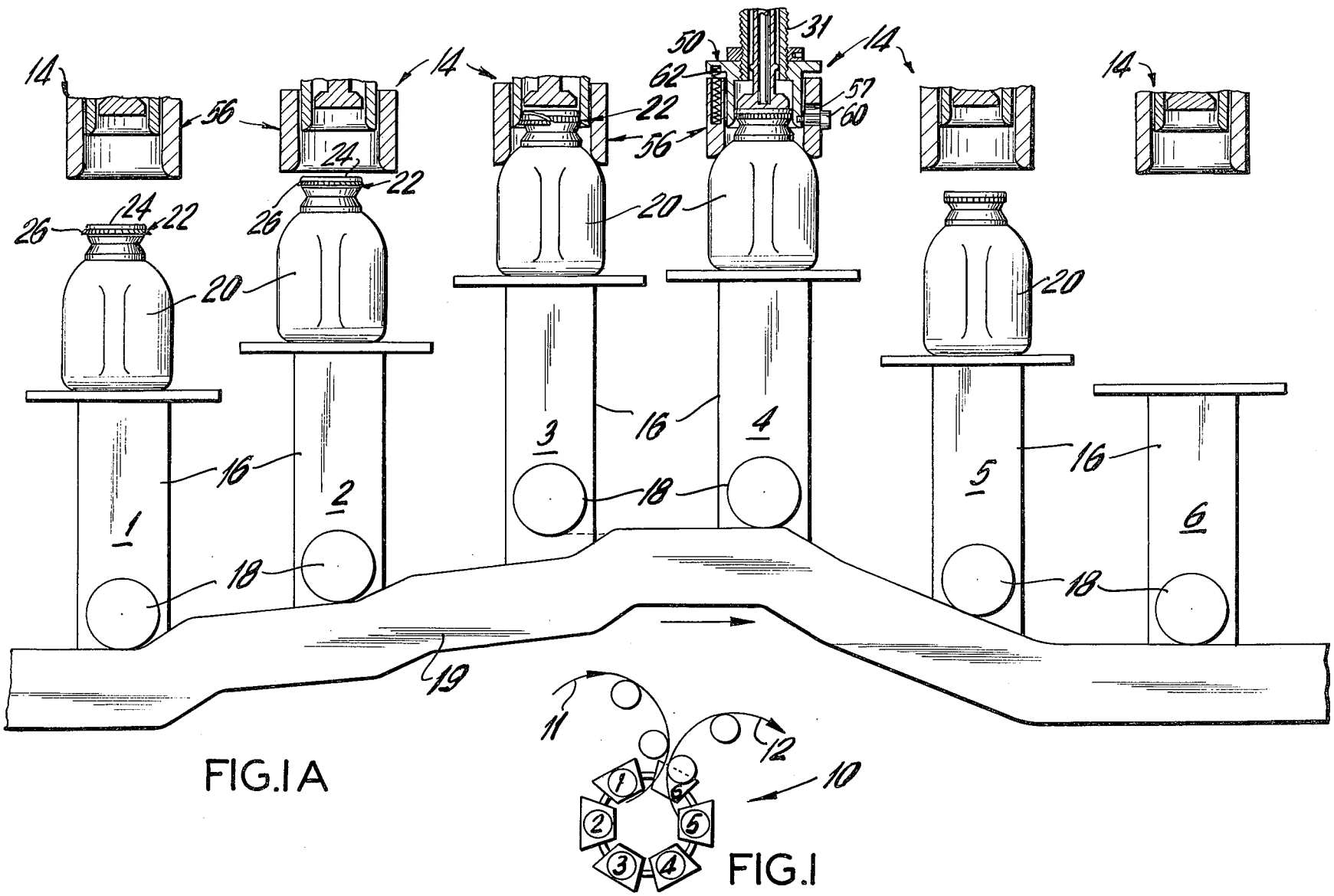
FIG. 1 is a schematic plan view of the stools of a carousel type of conveying system embodied in conventional filling apparatus for containers.
FIG. 1A is a schematic illustration of the instantaneous positioning of six stools of the conveying system illustrated in FIG. 1, with each of the containers on the conveyor being illustrated in relation to a heat seal capper head assembly of the subject invention.

Referring to FIG. 1, a carousel type of conveying apparatus 10 embodied in a conventional filling apparatus is illustrated without depiction of the associated heat sealing capping apparatus of the subject invention. The latter is disposed above and rotates with the carousel apparatus 10. At each station of the carousel apparatus, one phase of the heat sealing procedure takes place, and at the end of the heat sealing operation the bottle is returned to a conveyor means and carried away to a point where it can be packaged and loaded for transport to the consumer outlet. As shown in FIG. 1, six stations, designated 1 through 6 inclusive, are included in the conveying apparatus 10, and FIG. 1A depicts the instantaneous position of the progression of the six stools of the conveying system 10. Preparatory to entering the carousel apparatus 10, each bottle 20 to be capped is hooded with a heat seal cap at a location upstream of the carousel apparatus, and conveyed along a conveyor, as designated by arrow 11 to the first available stool of apparatus 10. After the heat sealing operation is completed, corresponding to the location of station 6, the bottle is conveyed in the direction designated by the arrow 12 to a point for final packaging.

An array of heat seal capper head assemblies 14, made according to the teachings of the subject invention, is mounted on a conventional filling machine that rotates in unison with and above the carousel type conveying apparatus in order to effect heat sealing of bottle caps 22.

Figure 3:
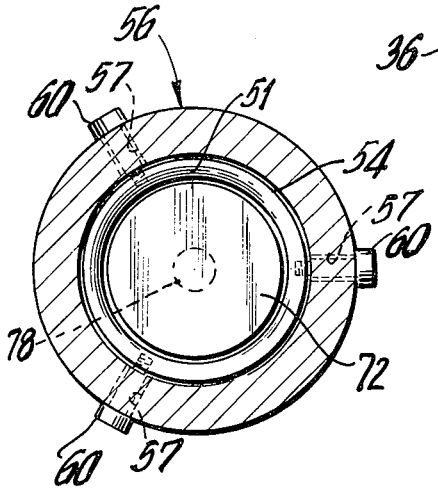
FIG. 3 is a sectional view of the subject heat seal capper head assembly taken along line 3—3 in FIG. 2.
Figure 2:
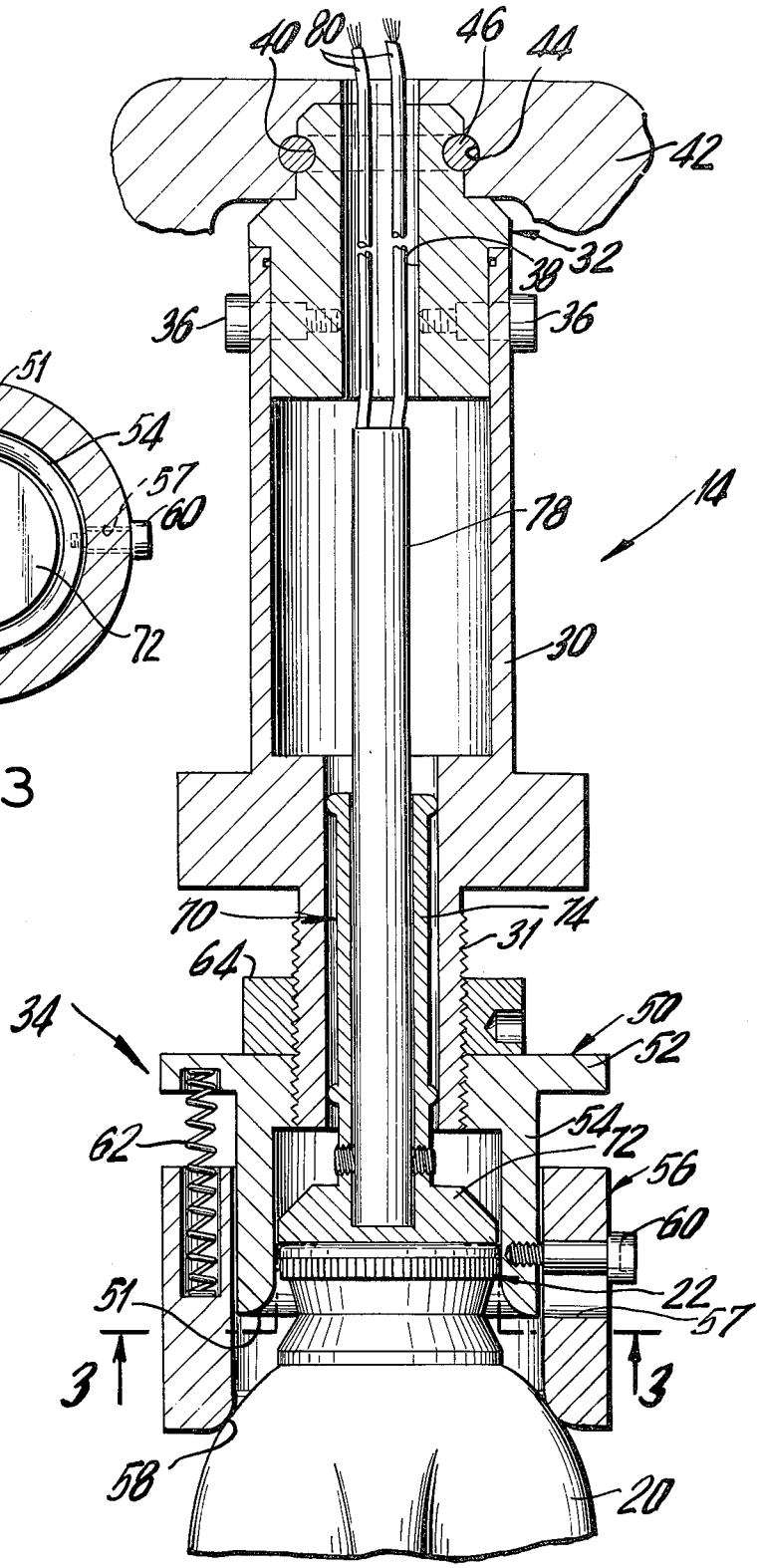
FIG. 2 is a longitudinal sectional view of the heat seal capper head assembly of the subject invention.

Referring to FIGS. 2 and 3, the heat seal capper head assembly 14 basically comprises a tubular housing 30 having at one end an adaptor 32 for mounting assembly 14 on a conventional filling apparatus, while at the opposite end of the housing 30 there is provided the folding and heat sealing means, generally designated by the numeral 34. Adaptor 32 is secured to the housing 30 by means of screws 36 and includes a central opening 38, as well as a circumferential groove 40.

In order to releasably connect the heat seal capper head assembly 14 to conventional filling apparatus, a fixture 42 is provided which is secured at one end to the filling apparatus (not shown), and includes an internal peripheral groove 44 that cooperates with groove 40 to define an annular opening into which a U-shaped pin 46 may be mounted for releasably connecting assembly 14 to the filling apparatus.

Disposed at the opposite end of the tubular housing 30 is the folding and heat sealing means 34 which includes an annular collar having a folder ring 50 threadedly connected to the threaded portion 31 of the tubular housing 30. The folder ring 50 has a peripheral flange portion 52 and a depending annular segment 54. Concentric with and surrounding segment 54 is a center collar 56, that is slidably connected to said folder ring 50 by an array of bolts 60 that extend through a corresponding array of longitudinally extending slots 57 in said center collar. By this arrangement, the collar 56 of the annular collar may be moved longitudinally relative to the folder ring 50. Extending between the flange 52 of the folder ring 50 and the center collar is array of springs 62 biasing the center collar downwardly away from the tubular housing 30. An adjustment nut 64 is also threadedly connected to the threaded portion 31 of the tubular housing and is employed for providing a rigid locking means for the folding and heat sealing means 34.

As shown in FIG. 2 the internal peripheral end portion 51 of the folder ring 50 is rounded for facilitating folding of the heat sealing cap above the opening of the container 20 to form the skirt portion of the heat seal cap. Likewise internal portion 58 of center collar 56 is rounded to facilitate its engagement with container 20.

Disposed internally of the folder ring and the end portion of the tubular housing 30 is a heat sealing head 70 which comprises a disc shaped end portion 72 and an elongated hollow stem portion 74. Positioned internally of the elongated hollow stem portion 74 is the heating means in the form of a cartridge heater 78 that is connected via leads 80 extending through the central opening 38 of the adaptor 32 to a source of electricity. Preferably, thermostat means are provided for maintaining the temperature of the cartridge heater at the required level for the heat sealing operation.

Referring to FIG. 1A, at station 1 of the conveying means, bottle 20 is shown entered the capping apparatus after being hooded with a heat seal cap upstream of station number 1. The bottle 20 is mounted on the pedestal of stool 16, and as the conveying apparatus 10 is rotated, stool 16 is elevated and lowered by means of roller 18 (secured to the stool 16) riding on cam track 19. The heat seal cap 22 is initially formed to include a central portion 24 and a skirt portion 26.

At the second station, the bottle is shown slightly out of line with respect to the heat sealing capping apparatus 14 of the subject invention, but the bottle will be realigned and centered as it is elevated and engages the center collar 56. It is noted that the rounded internal peripheral edge 58 of the center collar facilitates centering of the bottle on the stool preparatory for the heat seal capping operation.

At the third station, the cap is shown in two positions, with the leftmost position (as viewed in FIG. 1A) illustrating the position of the cap skirt 26 prior to being folded, while the right portion of the cap is shown when the bottle has been sufficiently elevated such that the peripheral surface 51 of the folder ring 50 engages the skirt portion 26 of the heat seal cap 22 and folds said portion downwardly about the neck of the bottle. It is noted that, as shown at station three in FIG. 1A, the third stool is shown raised to a position corresponding to the dotted line extending between roller 18 and the cam track 19 in order to depict the folded position of the skirt portion.

Referring to the fourth station in FIG. 1A, the central portion 24 of cap 22 abuts against the sealing head 70, and the stool has reached its maximum height. At such time heat is transferred from the cartride heater 78 through the sealing head 70 in order to apply heat to the composite heat seal cap 22. The application of heat causes shrinkage of the cap's plastic film thereby forming a fluid tight seal between the heat seal cap 22 and the container 20. At such time the center collar is forced upwardly against the biasing force of springs 62. Accordingly, as the stool progresses along the cam track 15 from station four to station five, the stool is gradually lowered, and the action of the array of springs 62 pushes the bottle 20 out of the heat seal capper head assembly thereby preventing the stool from lowering without the bottle. At station 5, as illustrated, the heat seal closure is completed, and the bottle is below the heat seal capping assembly of the subject invention. As previously noted, at the sixth station, the container is transferred to a conveyor for ultimate packaging and distributing to a consumer outlet.

The heat seal capper head assembly of the subject invention provides a new and improved means for heat sealing composite caps to all-plastic containers. The assembly is adapted to be mounted on existing filling equipment, and connected to an electrical control panel containing the necessary apparatus to allow the correct temperature in the individual sealing heads. After the heat in the sealing heads has reached a maximum point as shown on a suitable control panel, the operation is ready for filled containers to be capped and sealed. Each container is sent through a filling valve and after being filled is transferred to the pedestal of a stool. The latter, as it travels in a rotary motion, is elevated by means of the cam track. At the time of the heat seal process the skirt of the cap is folded to a position parallel to the neck of the bottle. When the bottle is elevated to the highest point on the cam, it is engaged in the capper head assembly and the heat is transferred from the capper head through the aluminum foil and activates the heat seal film that fuses to the plastic bottle. This requires approximately one to two seconds depending, of course on factors such as the speed of the filling apparatus, and the difficulty of heat sealing caused by the thickness and materials of the bottle cap and the bottle.

We claim:

1. A heat seal cap head assembly for securing a heat seal capper to a container to form a heat seal closure having a central portion and a skirt comprising:

an elongated tubular housing;

adapter means secured to one end of the housing for mounting the assembly on a conventional filling apparatus for the container;

and a folding and heat sealing means secured to the opposite end of the housing, said folding and heat sealing means including, an annular collar extending beyond the end of the housing and operative for folding each cap about the opening of the container to form the skirt portion thereof; and heating means disposed internally of the annular collar for applying heat to the cap to form a fluid tight closure for the container, which annular collar includes the combination of an annular folder ring fixedly secured to the end of the housing, and an annular center collar concentric with and slidably mounted on said folder ring, with spring means disposed between said annular folder ring and the center collar for braising the center collar toward its extended position.

2. A heat seal capper head assembly as in claim 1 further including means for varying the spring biasing force between the folder ring and the center collar.

3. A heat seal capper head assembly as in claim 1 wherein both the folder ring and the center collar include internal peripheral end portions, with the latter of both the folder ring and the center collar being rounded for facilitating folding of the heat seal capper about the opening of the container to form the skirt portion of the heat seal cap.

4. A heat seal capper head assembly as in claim 1 wherein the heating means comprises a sealing head having a disc shaped end portion disposed within the annular collar, and an elongated, hollow stem portion, with a cartridge heater disposed within said stem portion, and a source of electricity connected to said cartridge heater.

5. A heat seal capper head assembly as in claim 1 wherein said adaptor includes a reduced diameter portion extending beyond the end of the housing, which portion has an annular peripheral groove for accomodating locking means for releasably securing the capper to said filling apparatus.

6. A heat seal capper head assembly as in claim 1 in combination with a carousel type conveying means including cam means for elevating each container to a position for engagement with the folding and heat sealing means.

* * * * *